US008602218B2

(12) United States Patent
Grosskopf

(10) Patent No.: US 8,602,218 B2
(45) Date of Patent: Dec. 10, 2013

(54) CHILD-RESISTANT PACKAGING CONTAINER AND BLANK AND METHOD FOR MAKING THE SAME

(75) Inventor: Glenn A. Grosskopf, Lake Zurich, IL (US)

(73) Assignee: Colbert Packaging Corporation, Lake Forest, IL (US)

( * ) Notice: Subject to any disclaimer, the term of this patent is extended or adjusted under 35 U.S.C. 154(b) by 132 days.

(21) Appl. No.: 13/206,745

(22) Filed: Aug. 10, 2011

(65) Prior Publication Data

US 2012/0037517 A1 Feb. 16, 2012

Related U.S. Application Data

(60) Provisional application No. 61/372,198, filed on Aug. 10, 2010.

(51) Int. Cl.
*B65D 85/42* (2006.01)

(52) U.S. Cl.
USPC ..... 206/531; 206/528

(58) Field of Classification Search
USPC ..... 206/528, 531, 532, 534.1, 534.2, 536, 206/538, 539, 468; 229/125.125; 220/345.3
See application file for complete search history.

(56) References Cited

U.S. PATENT DOCUMENTS

| | | | | |
|---|---|---|---|---|
| 4,174,034 | A | | 11/1979 | Hoo |
| 4,284,204 | A | | 8/1981 | Carey, Jr. |
| 4,848,582 | A | * | 7/1989 | Levasseur et al. ..... 206/534.2 |
| 5,082,137 | A | | 1/1992 | Weinstein |
| 5,275,291 | A | | 1/1994 | Sledge |
| 5,878,887 | A | | 3/1999 | Parker et al. |
| 6,047,829 | A | | 4/2000 | Johnstone et al. |
| 6,230,893 | B1 | | 5/2001 | Karow |
| 6,412,636 | B1 | | 7/2002 | Jones et al. |
| 6,491,211 | B1 | | 12/2002 | Evans et al. |
| 6,641,031 | B2 | | 11/2003 | Evans et al. |
| 6,752,272 | B2 | | 6/2004 | Jones et al. |
| 6,848,580 | B2 | | 2/2005 | Paliotta et al. |
| 6,874,636 | B2 | | 4/2005 | Paliotta et al. |
| 7,090,079 | B2 | | 8/2006 | Ehrlund |

(Continued)

FOREIGN PATENT DOCUMENTS

| | | | |
|---|---|---|---|
| GB | 2042476 | A | 9/1980 |
| WO | 97/38919 | A1 | 10/1997 |

OTHER PUBLICATIONS

Korean Intellectual Property Office, International Search Report and Written Opinion of the International Searching Authority, issued in corresponding International Application No. PCT/US2011/047195 on Apr. 18, 2012.

(Continued)

*Primary Examiner* — David Fidei
(74) *Attorney, Agent, or Firm* — Patzik, Frank & Samotny Ltd.

(57) ABSTRACT

A childproof and senior friendly packaging container having a housing that defines a chamber for removably receiving a blister card or sheet. The blister sheet includes a flap on its end that is designed to engage a flap extending into the chamber of the housing to retain the blister card within the housing in an extended position. A node on the blister card flap is sized to fit within a slot or hole on the housing to retain the blister card in a stored position.

16 Claims, 6 Drawing Sheets

(56) References Cited

U.S. PATENT DOCUMENTS

| | | | | |
|---|---|---|---|---|
| 7,201,274 | B2 | 4/2007 | Paliotta et al. | |
| 7,325,689 | B2 | 2/2008 | Buss | |
| 7,389,875 | B2 | 6/2008 | Sandberg et al. | |
| 7,588,149 | B2 | 9/2009 | Gelardi | |
| 7,617,935 | B2 | 11/2009 | Reilley et al. | |
| 7,658,287 | B2 | 2/2010 | Hession | |
| 7,708,142 | B2 | 5/2010 | Ehrlund | |
| 7,726,481 | B2 | 6/2010 | Grosskopf | |
| 7,845,496 | B2 * | 12/2010 | Hession | 206/538 |
| 8,132,671 | B2 | 3/2012 | Hession | |
| 8,220,634 | B2 | 7/2012 | Mowery | |
| 8,365,916 | B2 | 2/2013 | Gelardi | |
| 2006/0283760 | A1 | 12/2006 | Nivala | |
| 2009/0301924 | A1 | 12/2009 | Rondeau | |
| 2010/0084308 | A1 * | 4/2010 | Rigby | 206/531 |
| 2010/0243509 | A1 | 9/2010 | Gelardi | |
| 2012/0012497 | A1 * | 1/2012 | Weston et al. | 206/531 |
| 2012/0181204 | A1 * | 7/2012 | Bogdziewicz et al. | 206/468 |
| 2012/0267261 | A1 | 10/2012 | Gelardi | |
| 2013/0068651 | A1 | 3/2013 | Gelardi et al. | |

OTHER PUBLICATIONS

U.S. Patent and Trademark Office, International Preliminary Report on Patentability, issued in corresponding PCT Application No. PCT/US11/47195 on Jan. 22, 2013.

* cited by examiner

CHILD-RESISTANT PACKAGING CONTAINER AND BLANK AND METHOD FOR MAKING THE SAME

This application claims priority to U.S. provisional patent application Ser. No. 61/372,198, filed Aug. 10, 2010, the entirety of which is herein incorporated by reference.

FIELD OF THE INVENTION

This invention relates in general to packaging containers and, more particularly, to packaging containers that are child-resistant and senior friendly.

BACKGROUND OF THE INVENTION

The number of available consumer pharmaceuticals continues to grow for use in the diagnosis, cure, treatment and/or prevention of diseases or injuries. In fact, the use of pharmaceuticals is so prevalent that there are very few households where they are not present. Due to the chemical nature of many of these medicines, any unintended uses or overdoses may have very damaging or lethal consequences. This is especially true with children who do not understand or appreciate the dangers involved. Accordingly, there has been a need to make the packaging childproof. However, because many people who use pharmaceuticals are elderly and may have lost some of their physical strength and/or coordination, it is also important that any such packaging also be readily usable by senior citizens.

Therefore, there is a need to produce a packaging container that allows senior citizens and other intended users, but not children, to access the contents of the packaging.

SUMMARY OF THE INVENTION

The present invention is an improvement over the prior product packaging in the way that the packaging container secures the contents to prevent access from children, while still permitting a senior citizen to access the contents. In particular, the packaging container securely retains a slidable blister card or sheet within a housing that does not allow access to the contents until multiple steps are performed.

In one embodiment, the packaging container includes a bottom member and a top or cover that form a housing including a sleeve for receiving part of the blister card or sheet. The housing members may comprise a paper-based material, although it is appreciated that other materials may be used and not depart from the scope of the present invention.

The bottom member may be formed from a blank having a bottom panel, a sleeve bottom panel, a central panel, and a pair of wing members. In order to form the bottom member, the central panel is folded on top of the sleeve bottom panel so that a flap at the end of the central panel extends through a corresponding flap opening in the sleeve bottom panel. The central panel and sleeve bottom panel may then be folded over the bottom panel so that the flap extends upwardly, and slots on the bottom panel and sleeve bottom panel are aligned.

In order to construct the sleeve, sleeve side panels are folded upward until perpendicular with the sleeve bottom panel, wherein the wing members may be folded across and attached to one another. Once the bottom member is assembled, the cover, which may be a substantially seamless formed tray having an opening in one end, may be placed over and attached to the bottom member.

A blister sheet or card having one end folded down to form a flap having a pair of nodes extending outwardly therefrom may then be inserted with the flap side down into the opening of the housing until the nodes are biased into engagement with the slots on the sleeve bottom panel and bottom panel. In order to release the blister sheet, notches in the slots of the bottom panel may be pressed to bias the nodes out of engagement with the slots while the blister sheet is pulled axially out of the housing. The flap on the blister card will engage the flap extending into the interior of the housing to prevent the blister card from being completely withdrawn from the housing.

It is therefore an object of the present invention to provide a new packaging container that is child-resistant and senior-friendly.

Yet another object of the present invention is to provide a new packaging container that is better for the environment than conventional packaging containers.

Still another object of the present invention is to provide a new packaging container that is safer to open.

Yet another object of the present invention is to provide a packaging container that inhibits theft and the inadvertent opening of the packaging.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
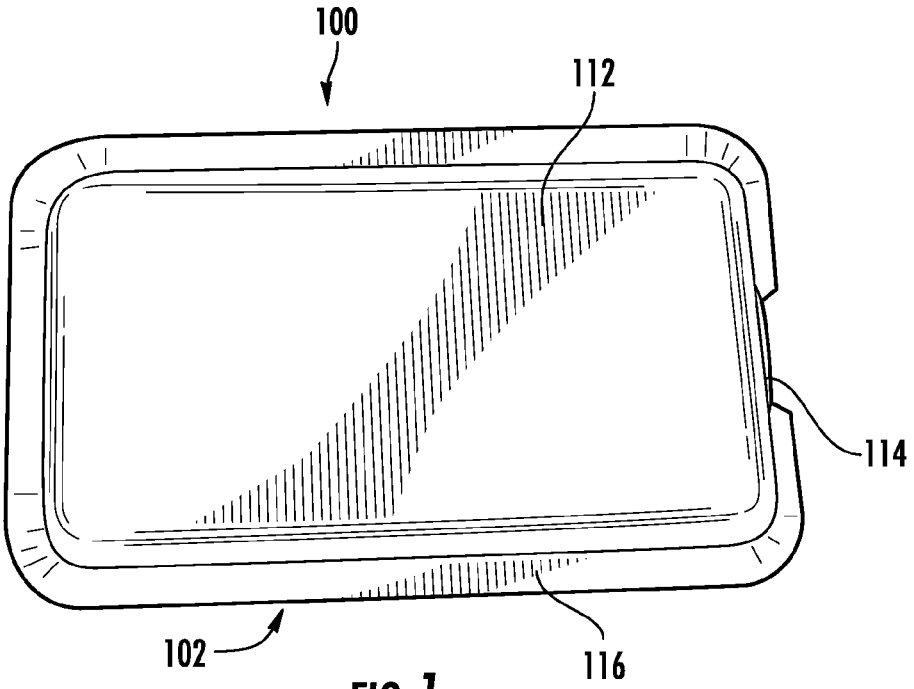
FIG. 1 is a top perspective view of one embodiment of the packaging container of the present invention.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 2:
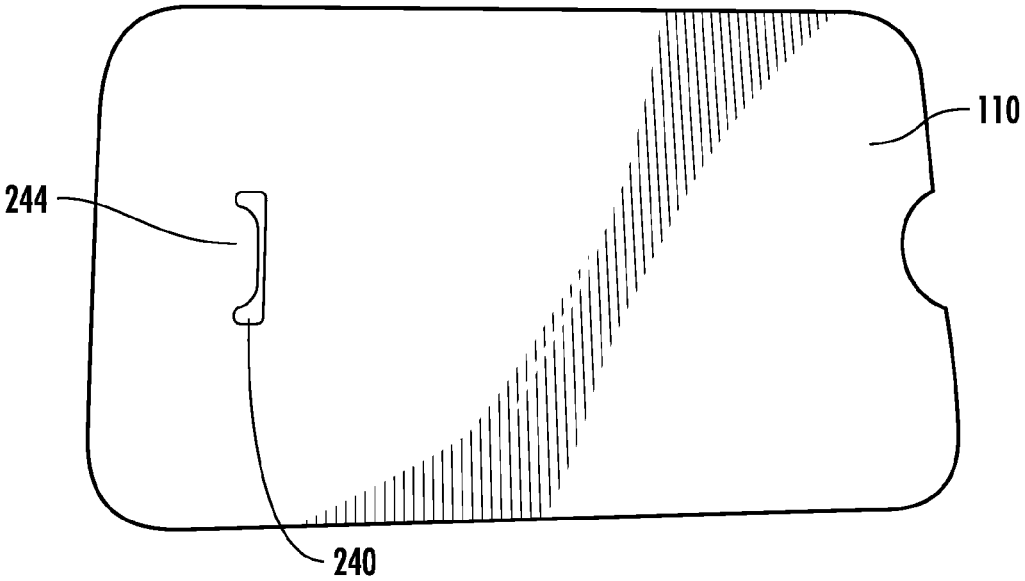
FIG. 2 is a bottom view of the packaging container shown in FIG. 1.
Figure 3:
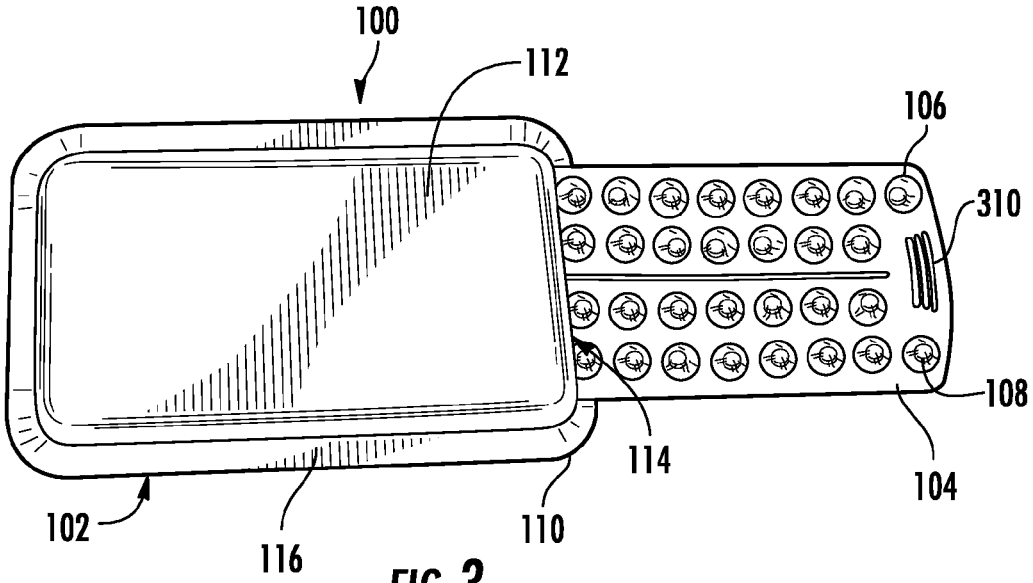
FIG. 3 is a top prospective view of the packaging container of FIG. 1 with a blister card extending outwardly therefrom.
Figure 4:
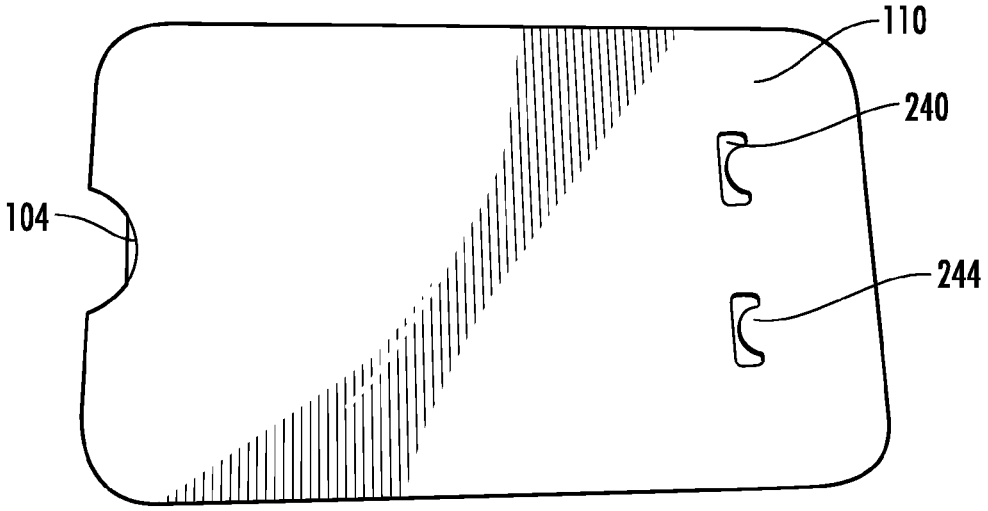
FIG. 4 is a bottom perspective view of another embodiment of the packaging container of the present invention.
Figure 5:
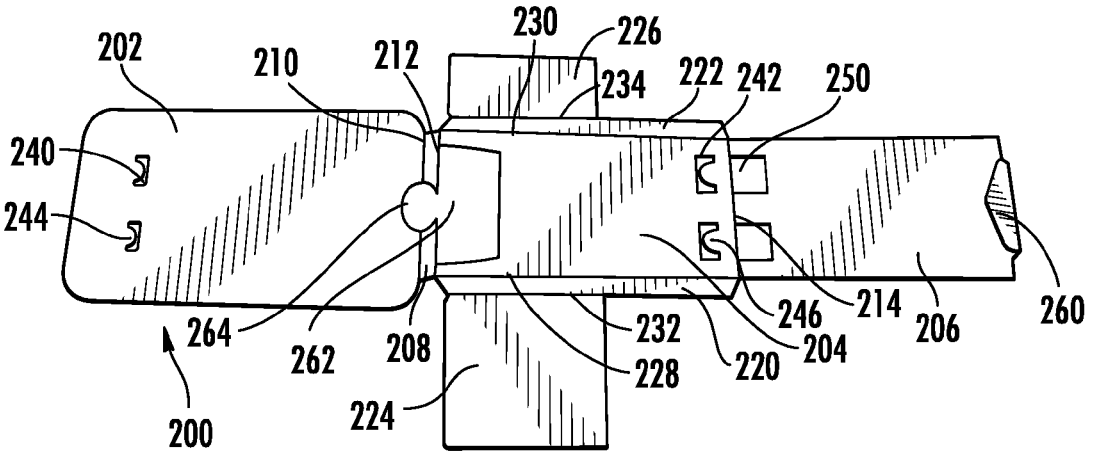
FIG. 5 is a top perspective view of a blank for the bottom member of the packaging container shown in FIG. 4.
Figure 6:
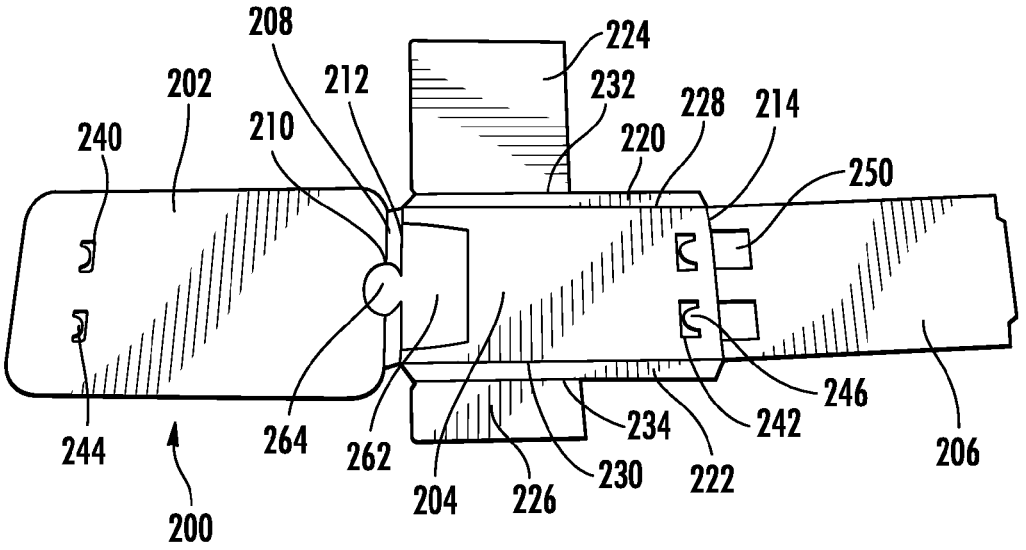
FIG. 6 is a bottom perspective view of a blank for the bottom member of the packaging container shown in FIG. 5.

Referring now to the drawings, and particularly to FIGS. 1 through 3, one embodiment of the improved product packaging container of the present invention, generally designated by the numeral 100, is shown having a housing 102 and a blister card or sheet 104 having a plurality of blisters or chambers 106 for storing the product 108 to be dispensed. In the embodiments shown and disclosed, the housing is made of a bottom member 110 and a cover or tray 112. The bottom member 110 and tray 112 can be two separate pieces or can be attached along one or more edges and not depart from the scope of the present invention.

In order to prevent access to the pills or other products 108 to be dispensed when within the housing from children, the housing 102 is preferably made from a material that is tear-resistant. One example of a material that may be used is a SBS board coated with a laminated material having directional grains that, when criss-crossed, adds strength to the housing and protects against tearing or tampering in two directions. A suitable coating is manufactured under the trademark VALERON™ by Valeron Strength Films. While VALERON is made from a polyethylene material, other such coatings such as, but not limited to, polypropylene or polyester may be used. The material used also is preferably printable to allow for advertising, promotional or other information to be displayed on the housing. While a SBS board with a cross-laminated coating is preferred, it is appreciated that other tear-resistant materials including, but not limited to, cloth films, cloth and plastic films, heat sealable boards and other coatings, also may be used and not depart from the scope of the present invention. Examples of cloth films and cloth and plastic films include those films sold under the names SCRIM and CLAF. A corrugate stock also may be used to achieve a more rigid finished packaging product.

The packaging container is adapted to be childproof by permitting the blister sheet 104 to be securely retained in a stored position within the housing 102 and only releasable upon the execution of a particular series of steps that are not likely to be figured out be a child. The packaging container is also adapted to inhibit the complete removal of the blister sheet 104 from the housing 102 by limiting the axial movement of the blister sheet 104.

Figure 7:
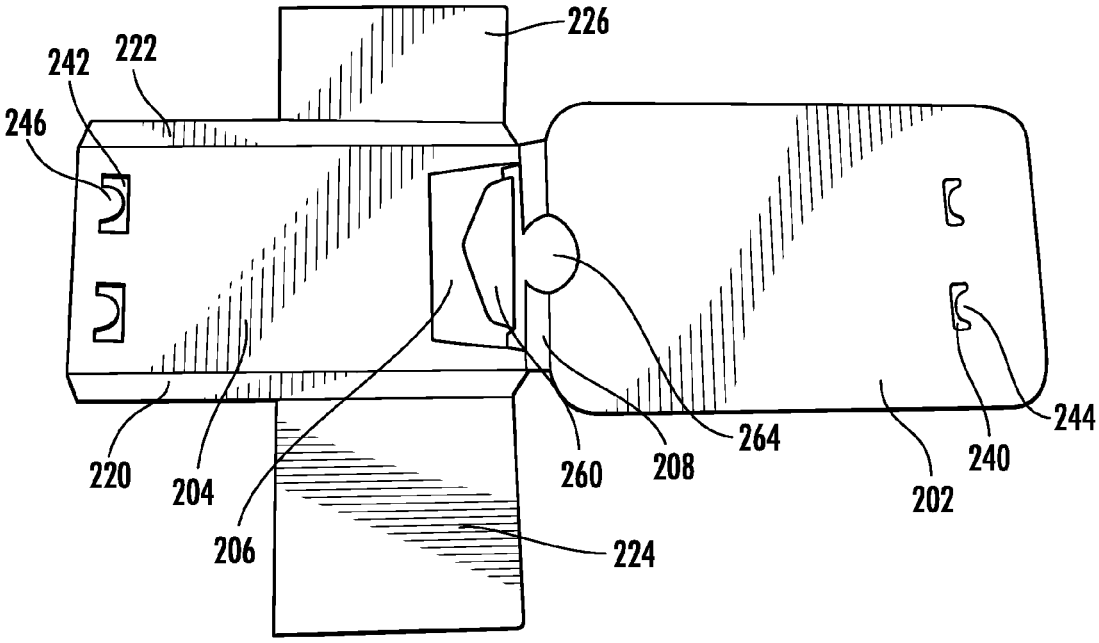
FIG. 7 is a top perspective view of the blank for the bottom member of the packaging container shown in FIG. 5 with the central panel folded under the sleeve bottom panel.
Figure 8:
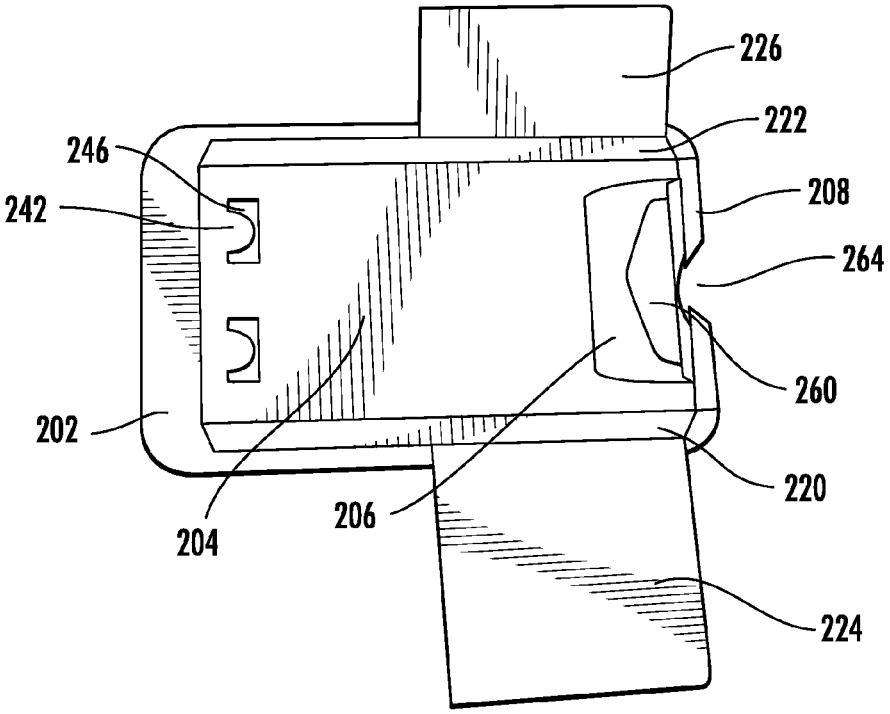
FIG. 8 is a top perspective view of the blank for the bottom member of the packaging container shown in FIG. 5 with the sleeve bottom panel and central panel folded over the bottom panel.
Figure 9:
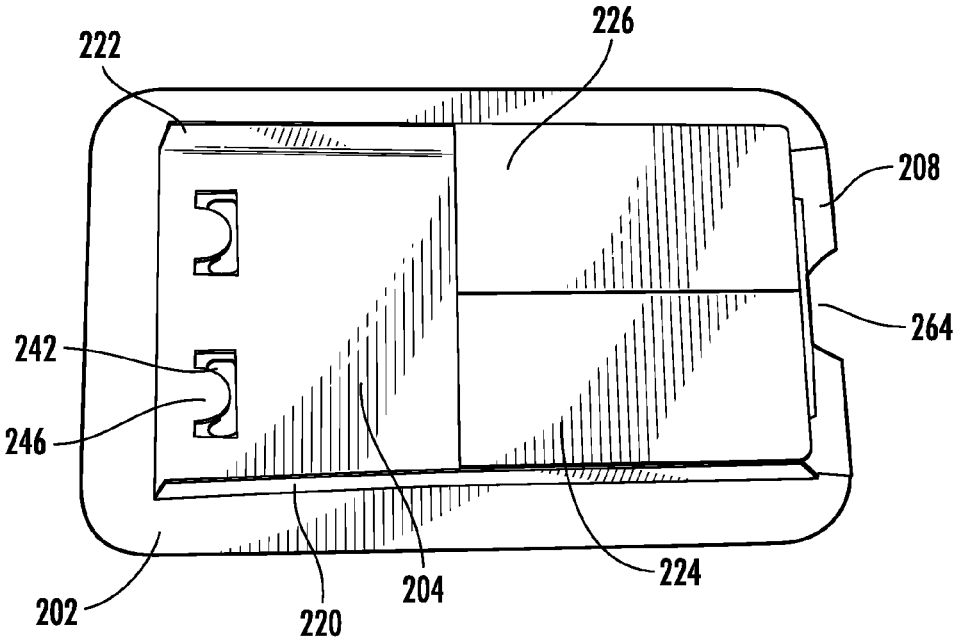
FIG. 9 is a top perspective view of the bottom member showing the wing members of the blank being folded over to form a sleeve.
Figure 10:
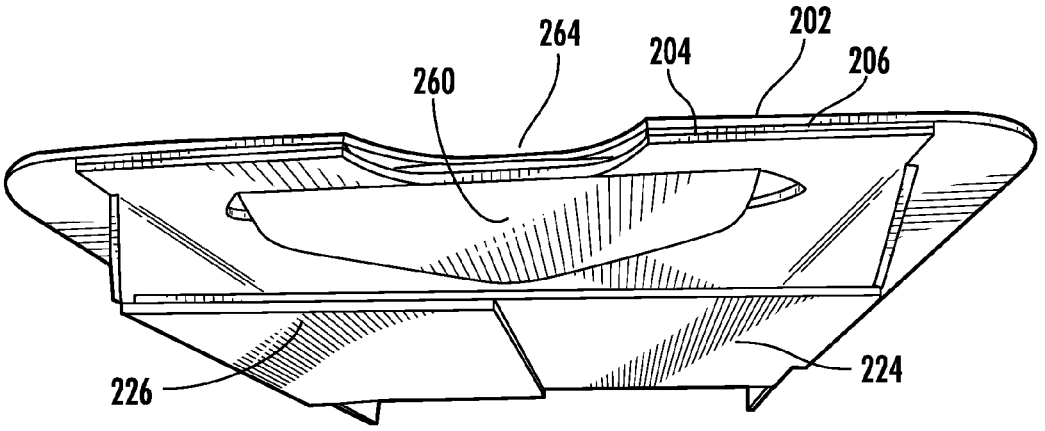
FIG. 10 is a side perspective view of the bottom member of the packaging container shown in FIG. 4.

The bottom member of the housing, as showing in FIGS. 9 and 10, may also define an interior sleeve for receiving the blister sheet. Referring now to FIGS. 5 through 9, the bottom member of the housing may be formed from an integral blank 200. The blank includes a bottom panel 202, a sleeve bottom panel 204 and a central panel 206. An end panel 208 joins the bottom panel 202 and the sleeve bottom panel 204 along fold lines 210 and 212. Central panel 206 is joined to the sleeve bottom panel 204 along fold line 214. A pair of sleeve side panels 220, 222 or members extend along the side of the sleeve bottom panel 204 and are joined to the sleeve bottom panel 204 and a pair of wing members 224, 226 by fold lines 228, 230, and 232, 234 respectively. In one embodiment, one of the wing members 224 is sized to extend substantially across the width of the sleeve bottom panel 204 when folded over.

Each of the bottom panel 202 and sleeve bottom panel 204 include a pair of rectangular slots 240, 242 with a pair of semi-circular notches 244, 246 extending therewithin. The slots and notches are located on the panels so that when the bottom member is formed, the slots and notches line up with one another. A pair of openings 250 are formed on the end of the central panel 206 to provide additional space between the two pair of slots 240, 242. While a pair of slots are shown and disclosed, referring to FIG. 2, it is appreciated that one, or more than two, slots or openings may be used and not depart from the scope of the present invention. It is further appreciated that the slots may be of a variety of sizes and shapes, and may be used without the notches and not depart from the scope of the present invention.

On the end of the back side of the central panel 206, a flap 260 extends inwardly. Flap opening 262 in the sleeve bottom panel 204 is sized to permit the flap 260 to extend into the sleeve interior when constructed. A semi-circular slot 264 may be formed in the end of the bottom panel 202 and the end panel 208 to create an opening in the end of the packaging container 100, as shown in FIG. 1, to permit fingers or the like to extend into the housing 102 and grab the blister sheet 104 to assist in its removal from the housing 102 to dispense the pills or other contents 108.

While three panels are shown and disclosed, it is appreciated that the bottom member may be formed without the central panel, wherein the flap would extend inwardly from the sleeve bottom panel.

The bottom member 110 may be formed in the following manner. While the various parts may be attached using adhesive, it is appreciated that they may be connected and held together by using any known means. As shown in FIG. 7, the central panel 206 is folded over and attached to the sleeve bottom panel 204 along fold line 214 so that the flap 260 extends through the flap opening 262 and the openings 250 are aligned with the slots 242 and notches 246. Referring to FIG. 8, the sleeve bottom panel 204 and central panel 206, along with the end panel 208 can then be folded over along fold line 210 and attached to the bottom panel 202. Sleeve slide panels 220, 222 may be folded along fold lines 228, 230 to extend substantially perpendicular to the sleeve bottom panel 204. Wing member 224 may then be folded along fold line 232 to extend over the opening created by the sleeve side panels 220, 222 and the sleeve bottom panel 204 such that the other wing member 226 may be folded along fold line 234 and attached to wing member 224 to define a sleeve for receiving part of the blister sheet 104 as disclosed in more detail below.

In the embodiment shown in FIG. 1, the top 112 of the housing 102 may be in the form of a tray having an opening 114 in one end and a rim 116 that extends around the remainder of the tray. In constructing the package, the tray may be placed over the formed bottom member so that the rim 116 may be attached to the portion of the bottom panel 202 around the sleeve.

In order to further assist in the prevention of theft of the package 100 and its contents, the interconnection between the walls of the top or cover 112 are preferably substantially seamless. Accordingly, the walls will not tend to separate or be easily separated by the consumer to facilitate the unwanted opening of the packaging container and removal of the contents. Additionally, the corners (if any) and/or sides of the chamber may be reinforced to further prevent any tampering with the chamber or its contents. Examples of chambers having reinforced corners and sides include, but are not limited to, chambers having their edges reinforced with fiber-reinforced tape or a fiber laminate, similar to a set-up box.

It is further appreciated that the tray may also contain an electronic security device such as, but not limited to, a product sensor/transmitter that will set off an alarm to indicate that a consumer or customer may be passing a security sensor and thereby leaving the store with an unpurchased product. Such a sensor would be deactivated upon payment for the product at the point of purchase.

Figure 11:
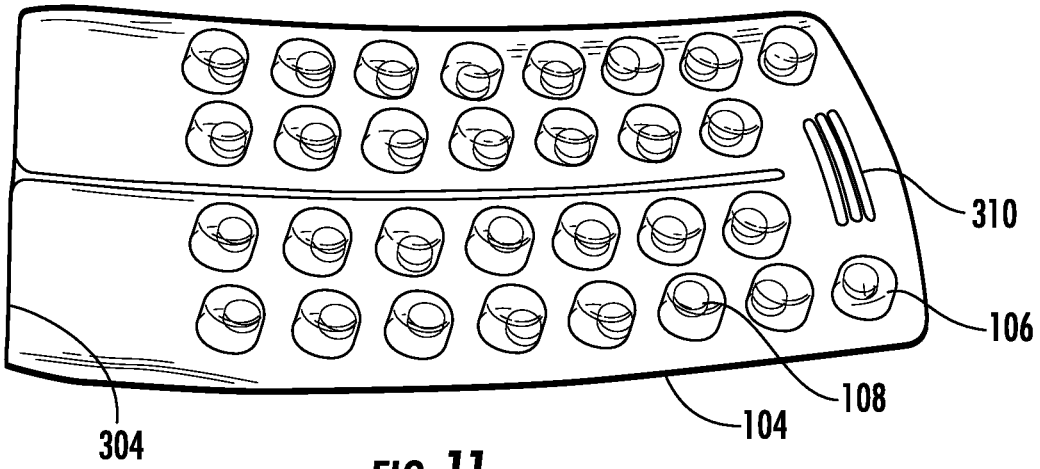
FIG. 11 is a top perspective view of a blister card for use with the second embodiment of the packaging container of the present invention.
Figure 12:
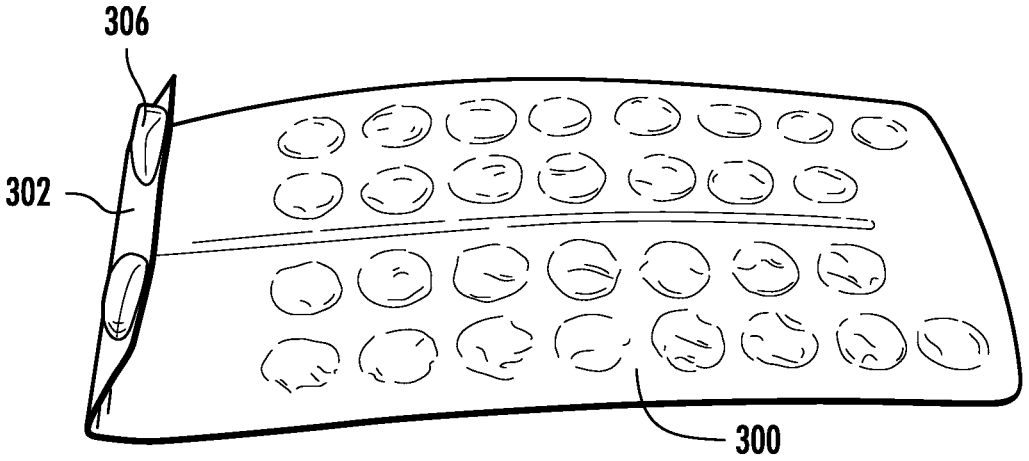
FIG. 12 is a bottom perspective view of the blister card shown in FIG. 11 for use with the second embodiment of the packaging container of the present invention.

Referring to FIG. 11, one embodiment of a blister sheet 104 for use with the present invention is shown. The blister sheet or card 104 is made from a substantially rigid material such as, but not limited to, aluminum or plastic. The blisters 106, which are preferably transparent to permit the contents 108 to be viewed, include a chamber that extends outwardly and a rim about the bottom of the chamber that interacts with the blister sheet to secure the blister in place. While the blister pack is shown as having thirty substantially round blisters 106, it is appreciated that the blister pack may have any number of blisters of varying sized and shapes and not depart from the scope of the present invention. A plurality of dispensing slots are formed on the bottom of the blister sheet 104 and are covered with a thin film or foil sheet 300 so that the pills 108 contained in blisters can be pushed through.

One end of the blister sheet 104 is folded over along line 304 to create a flap 302 that angles downwardly and inwardly. The material of the blister sheet is resilient so that when the flap is pushed upward toward the bottom of the blister sheet, the flap attempts to return to its original angled position. A pair of nodes 306 are spaced apart on the top of the flap 302 a distance that coincides with the distance between the pair of slots 240, 242 on the sleeve bottom panel 204 and packaging bottom panel 206. Raised areas 310 may be located at the other end of the blister sheet to provide a gripping area for a user to assist in removal of the blister sheet 104.

In operation, the blister sheet 104 is inserted into the opening 114 at the end of the package container 100 and slid until the nodes 306 of the flap 302 are biased into engagement with the slots 240, 242 of the sleeve bottom panel 204 and packaging bottom panel 202, thereby limiting further axial movement of the blister sheet 104 relative to the housing 102. To release the blister sheet 104, a user must push down on the notches on the bottom panel 202 of the packaging container 100 to push the nodes 306 out of engagement with the slots 240, 242, and grasp the exposed end of the blister sheet 104. The blister sheet 104 may then be slid and withdrawn from the housing until flap 302 engages the flap 260 on the inside of the housing 102 to prevent further withdrawal. Once the pill 108 is removed, the blister sheet 104 may be pushed back into the packaging housing 102 until the nodes 306 engage the slots 240, 242 so as to lock the blister sheet 104 in place.

It will be understood that modifications and variations may be effected without departing from the scope of the novel concepts of the present invention, but it is understood that this application is limited only by the scope of the appended claims.

The invention claimed is:

1. A packaging container comprising:
a housing comprising:
a bottom member having a first end and a second end with at least one slot proximate the first end and a first flap extending upwardly and inwardly proximate the second end; and
a cover;
wherein the bottom member and cover define a chamber and an opening at one end; and
a blister sheet sized to move through the opening and having a first end and a second end, wherein the blister sheet first end includes a second flap adapted to engage the first flap to retain the blister sheet within the housing when the blister sheet is in an extended position, the second flap having a top surface and at least one node extending outwardly from the top surface and that is adapted to releasably engage the at least one slot on the bottom member when the blister sheet is in a stored position for withdrawal thereof.

2. The packaging container of claim 1 wherein the cover is a formed tray that is attached to the bottom member.

3. The packaging container of claim 1 wherein the cover is substantially opaque.

4. The packaging container of claim 1 wherein the cover is substantially transparent.

5. The packaging container of claim 1 wherein the housing is made from substantial tear resistant material.

6. The packaging container of claim 5 wherein the substantial tear resistant material is a SBS board coated with a polyethylene material.

7. The packaging container of claim 1 wherein the blister sheet includes a raised surface on its second end.

8. The packaging container of claim 1 wherein the bottom member includes:
a bottom panel having the at least one slot;
a sleeve comprising:
a sleeve bottom panel having a flap opening for receiving the first flap and at least one slot that corresponds with the at least one slot on the bottom panel;
a pair of sleeve side panels; and a
sleeve top.

9. A packaging container comprising:
a housing comprising:
a bottom member having a first end and a second end with at least one slot proximate the first end and a first flap extending upwardly and inwardly proximate the second end; and
a cover;
wherein the bottom member and cover define a chamber and an opening at one end;
a blister sheet sized to move through the opening and having a first end and a second end, wherein the blister sheet first end includes a second flap adapted to engage the first flap to retain the blister sheet within the housing when the blister sheet is in an extended position, the second flap having at least one node extending outwardly therefrom and that is adapted to releasably engage the at least one slot on the bottom member when the blister sheet is in a stored position for withdrawal thereof;
a bottom panel having the at least one slot;
a sleeve comprising:
a sleeve bottom panel having a flap opening for receiving the first flap and at least one slot that corresponds with the at least one slot on the bottom panel;
a pair of sleeve side panels; and
a sleeve top including a pair of wing members attached to the sleeve side panels.

10. A packaging container comprising:
a housing comprising:
a bottom member having:
a first end;
a second end with at least one slot proximate the first end and a first flap extending upwardly and inwardly proximate the second end; and
a central panel located between the bottom panel and the sleeve bottom panel, the central panel includes the second flap and at least one opening that corresponds with the at least one slot on the bottom panel and the at least one slot on the sleeve bottom panel; and
a cover, wherein the bottom member and cover define a chamber and an opening at one end;
a blister sheet sized to move through the opening and having a first end and a second end, wherein the blister sheet first end includes a second flap adapted to engage the first flap to retain the blister sheet within the housing when the blister sheet is in an extended position, the second flap having at least one node extending outwardly therefrom and that is adapted to releasably engage the at least one slot on the bottom member when the blister sheet is in a stored position for withdrawal thereof;

a bottom panel having the at least one slot;

a sleeve comprising:

a sleeve bottom panel having a flap opening for receiving the first flap and at least one slot that corresponds with the at least one slot on the bottom panel;

a pair of sleeve side panels; and a sleeve top.

11. The packaging container of claim 1 wherein the housing is made from a printable material.

12. The packaging container of claim 1 wherein the housing is made from a paper product.

13. The packaging container of claim 1 wherein the bottom member further comprises a slot at its second end to facilitate grasping of the blister sheet in the stored position.

14. A method for forming a packaging container comprising the steps of:

forming a bottom member having a first end and a second end with at least one slot proximate the first end and a first flap extending upwardly and inwardly proximate the second end, placing a cover over the bottom member to form a housing having an opening at one end and defining a chamber therewithin;

inserting a blister sheet having a first end having a second flap having a top surface and at least one node extending outwardly from the top surface into the opening of the housing until the at least one node releasably engages the at least one slot on the bottom member in a stored position until withdrawal thereof.

15. The packaging container of claim 1 wherein the at least one node is a formed cavity.

16. The method of claim 14 wherein the at least one node is a formed cavity.

* * * * *